US009460839B2

(12) United States Patent
Minen et al.

(10) Patent No.: US 9,460,839 B2
(45) Date of Patent: Oct. 4, 2016

(54) ELECTROMAGNETIC STABILIZER

(71) Applicant: Danieli & C. Officine Meccaniche S.p.A., Buttrio (IT)

(72) Inventors: Michele Minen, Udine (IT); Fabio Guastini, Dolegno del Collio (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 0 days.

(21) Appl. No.: 14/427,937

(22) PCT Filed: Sep. 13, 2013

(86) PCT No.: PCT/IB2013/058530

§ 371 (c)(1),
(2) Date: Mar. 12, 2015

(87) PCT Pub. No.: WO2014/041515

PCT Pub. Date: Mar. 20, 2014

(65) Prior Publication Data

US 2015/0248961 A1 Sep. 3, 2015

(30) Foreign Application Priority Data

Sep. 14, 2012 (IT) ..... MI2012A1533

(51) Int. Cl.

| | |
|---|---|
| ***H01F 1/00*** | (2006.01) |
| ***H01F 3/00*** | (2006.01) |
| ***H01F 7/20*** | (2006.01) |
| ***C23C 2/00*** | (2006.01) |
| ***C23C 2/40*** | (2006.01) |
| ***B21D 1/00*** | (2006.01) |

(52) U.S. Cl.
CPC ..... *H01F 7/206* (2013.01); *B21D 1/00* (2013.01); *C23C 2/003* (2013.01); *C23C 2/40* (2013.01)

(58) Field of Classification Search
CPC ..... C23C 2/003; C23C 2/40; H01F 7/206; B21D 1/00
See application file for complete search history.

(56) References Cited

U.S. PATENT DOCUMENTS

| | | | | |
|---|---|---|---|---|
| 6,471,153 | B1 * | 10/2002 | Kimura | B21B 37/007 226/15 |
| 7,187,532 | B2 * | 3/2007 | Eriksson | B65H 23/04 361/143 |
| 8,752,502 | B2 * | 6/2014 | Eriksson | C23C 2/003 118/419 |
| 2011/0217481 | A1 * | 9/2011 | Ohara | C23C 2/003 427/547 |
| 2013/0010397 | A1 * | 1/2013 | Ohara | C23C 2/14 361/143 |

FOREIGN PATENT DOCUMENTS

| | | | |
|---|---|---|---|
| JP | 2000053295 | A1 | 2/2002 |
| WO | WO0214572 | A1 | 2/2002 |
| WO | WO2012114266 | A1 | 8/2012 |

* cited by examiner

*Primary Examiner* — Bernard Rojas
(74) *Attorney, Agent, or Firm* — Stetina Brunda Garred & Brucker

(57) ABSTRACT

An electromagnetic stabilizer includes a first and a second plurality of electromagnets aligned along a transversal direction orthogonal to a feeding direction of the strip. The first and second plurality of electromagnets are mutually arranged in a position mirroring the theoretical feeding plane. Each of the electromagnets includes: a core provided with at least a first and a second pole; a first and a second coil wound about the first and second poles, respectively; two power sources to supply the coils, respectively, so as to generate a first and a second magnetic field, respectively; and at least one concentrator made of ferromagnetic material connected to the core and arranged so as to make the first and the second coil magnetically independent of each other.

14 Claims, 6 Drawing Sheets

ELECTROMAGNETIC STABILIZER

CROSS REFERENCE TO RELATED APPLICATIONS

The present application claims priority to PCT International Application No. PCT/IB2013/058530 filed on Sep. 13, 2013, which application claims priority to Italian Patent Application No. MI2012A001533 filed Sep. 14, 2012, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention falls within the scope of systems and processes for coating flat bodies of ferromagnetic material, such as steel strips. In particular, the invention relates to an electromagnetic stabilizer for stabilizing and correcting the deformation of a strip of ferromagnetic material during a coating process of the same metal strip with molten metal (such as a galvanizing process). The present invention further relates to a system for coating a metal strip with molten metal comprising such an electromagnetic stabilizer.

PRIOR ART

As known, strips of ferromagnetic material, such as metal strips, can be externally coated through a plurality of coating processes, for example by means of a galvanizing process.

In such coating processes, the metal strip is normally subject to deformations and vibrations, corrected by the use of electromagnetic devices. For example, with reference to FIGS. 1 and 2, a known electromagnetic device used for locally stabilizing a metal strip M consists of a plurality of facing pairs of electromagnetic actuators 10. Each actuator comprises a core of ferromagnetic material including a pair of poles on which a pair of coils 2', 2" are respectively wound, the pair of coils 2', 2" being mutually spaced along the feeding direction 100 of the metal strip M. Due to the electric current circulating in coils 2' and 2", the electromagnetic actuators 10 generate magnetic forces which are active on the magnetic strip M, so as to stabilize and correct the shape of strip M itself during the coating process. Each pair of electromagnetic actuators 10 is aligned with at least another pair of electromagnetic actuators 10 according to a direction 100' orthogonal to the feeding direction 100 of the metal strip M. Each pair of electromagnetic actuators is supplied by power sources, typically controlled by a closed loop controller. The control signal, which determines the level of electric current of each electromagnet, is generated as a function of operational information such as the position taken by the metal strip M with respect to a theoretical feeding plane, the thickness and uniformity of the coating, the thickness and/or width of the metal strip M, the feeding speed of the strip itself. The position of the metal strip M with respect to the theoretical feeding plane is measured using a plurality of position sensors 11.

An electromagnetic device of the above-described type, through the application of the aforesaid magnetic forces, must exert a first action to correct the transversal deformation of the metal strip M and a second action to reduce the oscillations of the metal strip M. In general, static or slowly time-varying magnetic fields will have to be generated to exert the first action and rapidly time-varying magnetic fields for the second action. Such two actions result in two different needs. In fact, in order to exert the first action it is necessary to maximize the intensity of the force applied to the metal strip M while in order to exert the second one it is necessary to maximize the dynamic response, i.e. the rate of change of the magnetic force.

These two requirements are mutually conflicting. From the electromagnetic point of view, in order to maximize the magnetic force it is necessary to increase the number of turns of coils 2' and 2" wound on the core of the electromagnetic actuator 10 or increase the section of the pole on which they are wound while in order to obtain the maximum dynamic response, the number of turns of coils 2' and 2" must be limited or the section of the pole on which they are wound must be limited.

A possible solution to this problem is to make two separate electromagnetic devices, one dedicated to correct the deformation, in which the electromagnetic force is maximized, and the other dedicated to reducing the oscillations, in which the variation speed of the magnetic field, and hence of the electromagnetic force generated, is instead maximized. The main drawback of this solution is the lack of compactness of the device thus conceived.

A second solution, which prevents having to make two separate devices and, at the same time, implements a compact device, is to provide one or more coils 2' 2" placed on the same core of a same electromagnetic actuator 10. The coils can be both supplied by a same power source, oversized with respect what is necessary and coupled to a controller connected to the position sensors (solution not shown). Alternatively, according to a third embodiment shown in FIG. 2, coils 2' and 2" are supplied by two respective and distinct power sources 4' and 4".

The main drawbacks of this second solution are determined by the need of oversizing the only power source present and by the reduced capacity to reduce the oscillations. With this solution, in fact, both the first and the second one of the desired corrective actions are obtained by magnetically using the same narrow zone 5' of the metal strip M, as lines 7' (dash-dot lines) and 7" (continuous lines) of the two respective magnetic fields produced by coils 2' and 2" develop along the same path. According to the conditions of magnetic saturation of the metal strip M, which has a limited thickness (normally in the range between 0.3 mm and 5 mm), and of the electromagnetic actuator 10, the parameters of controller 6 must be continuously corrected to ensure the control stability. Such an operation is not very efficient since, in order to ensure the stability of the closed loop control system, the parameters of controller 6 must be corrected whenever the coating process is applied to a metal strip M of different thickness, as known for example from document US20110217481.

In the above-described known solutions, moreover, coils 2', 2" are accommodated on a same core and thus are always magnetically coupled, even when sources 4' and 4" are separated. This makes sources 4' and 4" not work optimally as they too are mutually electrically coupled through the respective magnetic fields 7', 7". In fact, the variable magnetic field 7", originated by the second coil 2", generates electric currents induced in the first coil 2' wound on a same ferromagnetic core, which overlap the main electric current generated therein by the first source 4'. The electrical uncoupling of the sources, which is necessary to ensure the regular operation of sources 4' and 4", is therefore not feasible because the sources interact through a same magnetic circuit. Accordingly, this results in a reduction in the performance of sources 4' and 4" and, in the worst case, in the impossibility of effectively controlling the sources themselves by controller 6.

SUMMARY OF THE INVENTION

Therefore, it is a specific object of the present invention to provide an electromagnetic device for stabilizing and reducing the deformation of a metal strip of ferromagnetic material, for example a metal strip, during a coating process of the strip itself, capable of obviating the above-mentioned drawbacks with reference to the cited prior art.

In particular, a device is provided which allows the two above-mentioned actions to be separated and made magnetically independent:

correcting the transversal deformation of the strip, and reducing the oscillations of the strip.

It is another object of the present invention to minimize the space occupied by the installation of the device itself.

Such objects are achieved by an electromagnetic stabilizer for stabilizing and correcting the deformation of a strip made of ferromagnetic metal material during its feeding, said device comprising:

a first plurality of electromagnets aligned along a transversal direction parallel to a theoretical feeding plane of said strip and orthogonal to a feeding direction of said strip, a second plurality of electromagnets arranged in a position mirroring said first plurality of electromagnets with respect to said theoretical plane, wherein each of said electromagnets comprises:

a core provided with at least a first and a second pole, at least a first and a second coil wound about said first and second poles, respectively, a first and a second power source to supply said first and second coils, respectively, so as to generate a first and a second magnetic field, respectively, a gap extending between said first and second coils, characterized in that each of said electromagnets further comprises at least one concentrator made of ferromagnetic material connected to said core and arranged in said gap so as to make said first and second coils magnetically independent of each other.

According to a further aspect of the invention, the aforementioned problems are solved by a process for stabilizing and correcting the deformation of a strip made of ferromagnetic metal material during its feeding, said process comprising the steps of:

generating a first plurality of magnetic fields aligned along a transversal direction parallel to a theoretical feeding plane of said strip and orthogonal to a feeding direction of said strip, said first plurality of magnetic fields being sized to correct the transversal deformation of said strip;

generating a second plurality of magnetic fields aligned along a transversal direction parallel to a theoretical feeding plane of said strip and orthogonal to a feeding direction of said strip, said second plurality of magnetic fields being spaced apart from said first plurality of magnetic fields along said feeding direction, said second plurality of magnetic fields being sized to correct the oscillations of said strip;

characterized in that it comprises the further step of interposing one or more ferromagnetic concentrators between said plurality of magnetic fields so as to make said first plurality of magnetic fields magnetically independent with respect to said second plurality of magnetic fields.

BRIEF DESCRIPTION OF THE DRAWINGS

Further features and advantages of the invention will become more apparent from the detailed description of preferred but non exclusive embodiments of an electromagnetic device according to the present invention, shown by way of a non-limiting example with the aid of the accompanying drawings, in which.

DETAILED DESCRIPTION OF THE INVENTION

Figure 1:
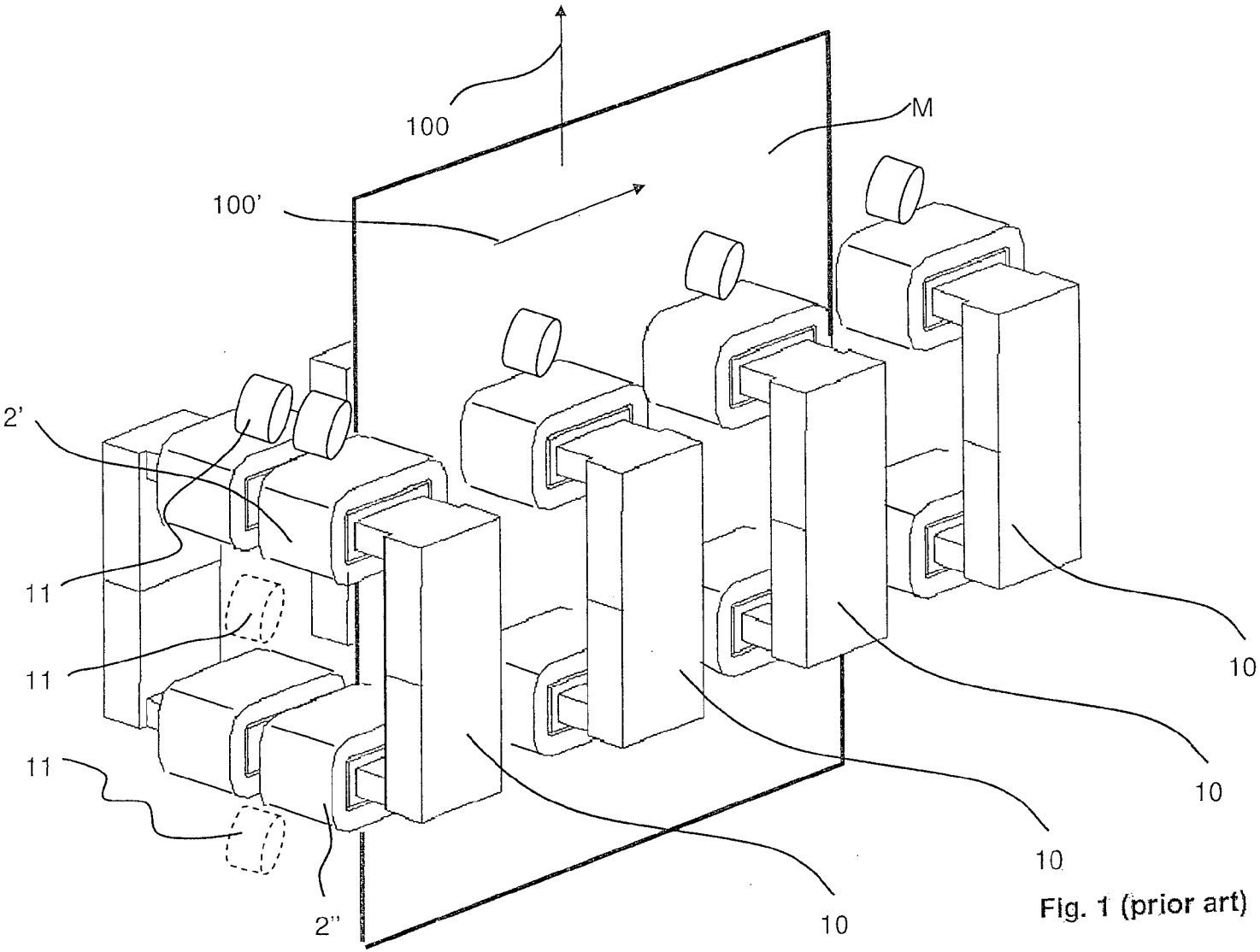
Fig. 1 (prior art)
FIG. 1 is an axonometric view of an electromagnetic stabilizer known from the prior art, used in systems for coating metal strips.
Figure 2:
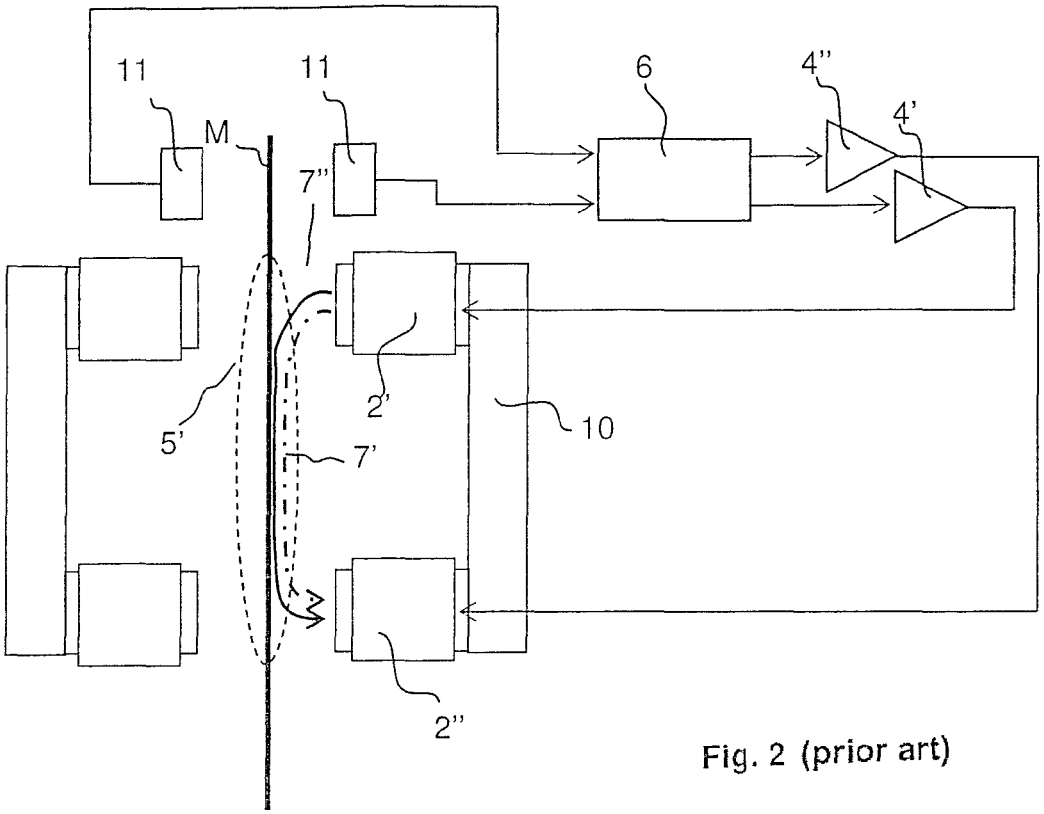
Fig. 2 (prior art)
FIG. 2 is a diagrammatic view of a known electromagnetic stabilizer, including a wiring diagram of the drive for controlling the generated magnetic field.

With reference to the accompanying FIGS. 3-8, an electromagnetic stabilizer 1 for stabilizing and correcting the deformation of a strip of ferromagnetic material is globally indicated with reference numeral 1.

The electromagnetic device 1 can be used to correct the transversal deformation of a strip M of ferromagnetic material and reduce the oscillations of the same during its feeding in a production process. In particular, the electromagnetic stabilizer 1 is particularly suitable to be used to stabilize the advancement of a strip M within a system which implements a coating process, such as a galvanizing process.

The electromagnetic stabilizer 1 can further be optionally used to intentionally produce a deformation on the strip itself.

FIGS. 3 to 8 refer to possible embodiments of an electromagnetic stabilizer 1 according to the present invention. The electromagnetic stabilizer 1 comprises a first plurality of electromagnets 15 and a second plurality of electromagnets 16. Electromagnets 15 of the first plurality are aligned along a transversal direction 100' substantially parallel to a theoretical feeding plane 50 of strip M and orthogonal to a feeding direction 100 parallel to the theoretical plane 50. Likewise, electromagnets 16 of the second plurality are arranged in a position mirroring said first plurality of electromagnets 15 with respect to the theoretical plane 50. Therefore, electromagnets 16 too are aligned along a direction also parallel to the theoretical feeding plane 50 of strip M and orthogonal to said feeding direction 100. For the purposes of the invention, the expression theoretical feeding plane 50 is intended to indicate a plane along which strip M should be theoretically fed in an ideal condition of no vibration and transversal profile of the strip not deformed, i.e. linear in the view in FIGS. 3 and 4.

Each electromagnet 15, 16 has a core 17 comprising at least a first pole 18' and a second pole 18" and at least a first coil 3' and a second coil 3", wound about the first and second poles 18', 18", respectively, and fed with an electric current of adjustable intensity.

Electromagnets 15 of the first plurality have the function of generating, through the power of the respective coils, respective magnetic fields from a first side of strip M. Likewise, electromagnets 16 of the second plurality have the function of generating respective magnetic fields in a position, with respect to the theoretical plane 50, mirroring that of the magnetic fields generated by electromagnets 15. In general, for the purposes of the present invention, the fields generated by each electromagnet 15, 16 are independent from the magnetic fields generated by all the other electromagnets 15, 16, each electromagnet 15, 16 being powered independently of the others, as explained in more detail in the following.

Figure 3:
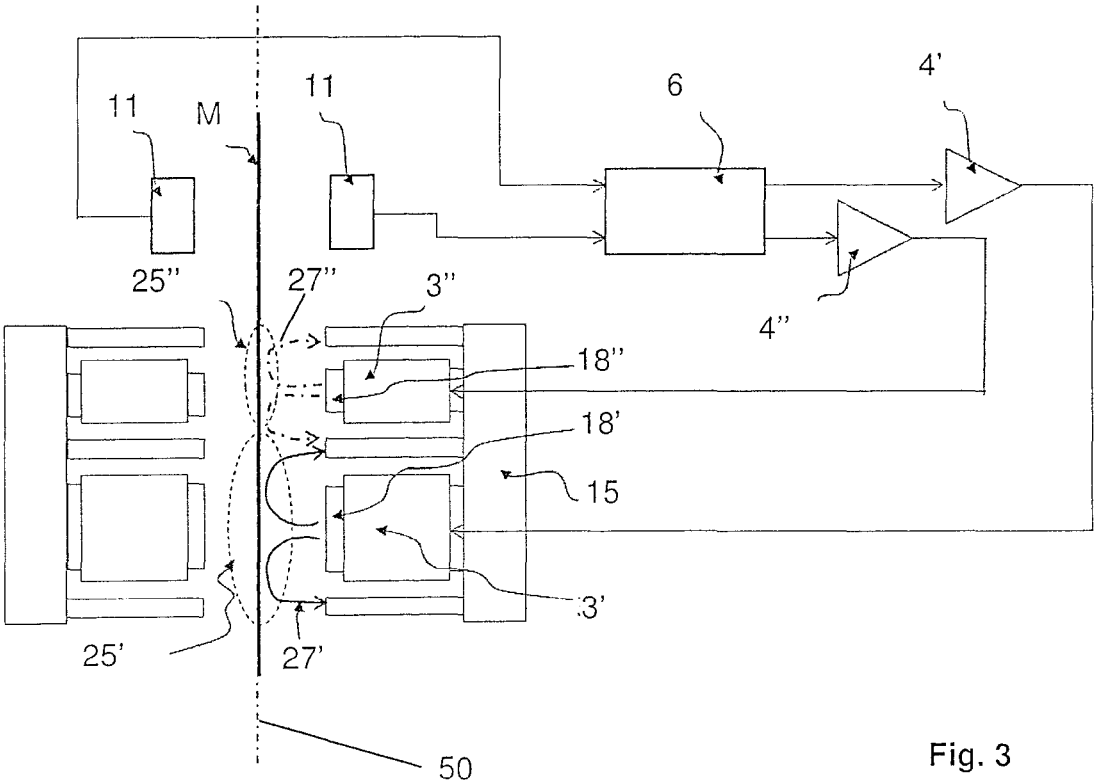
FIG. 3 is a diagrammatic view, corresponding to that in FIG. 2, of an electromagnetic stabilizer according to the present invention.

FIG. 3 shows a first embodiment of the present invention, in which core 17 of electromagnets 15, 16, made of ferromagnetic material, either rolled or not rolled, substantially has the shape of letter "C", thus comprising two poles 18', 18" and two coils 3', 3" respectively wound about them.

Figure 4:
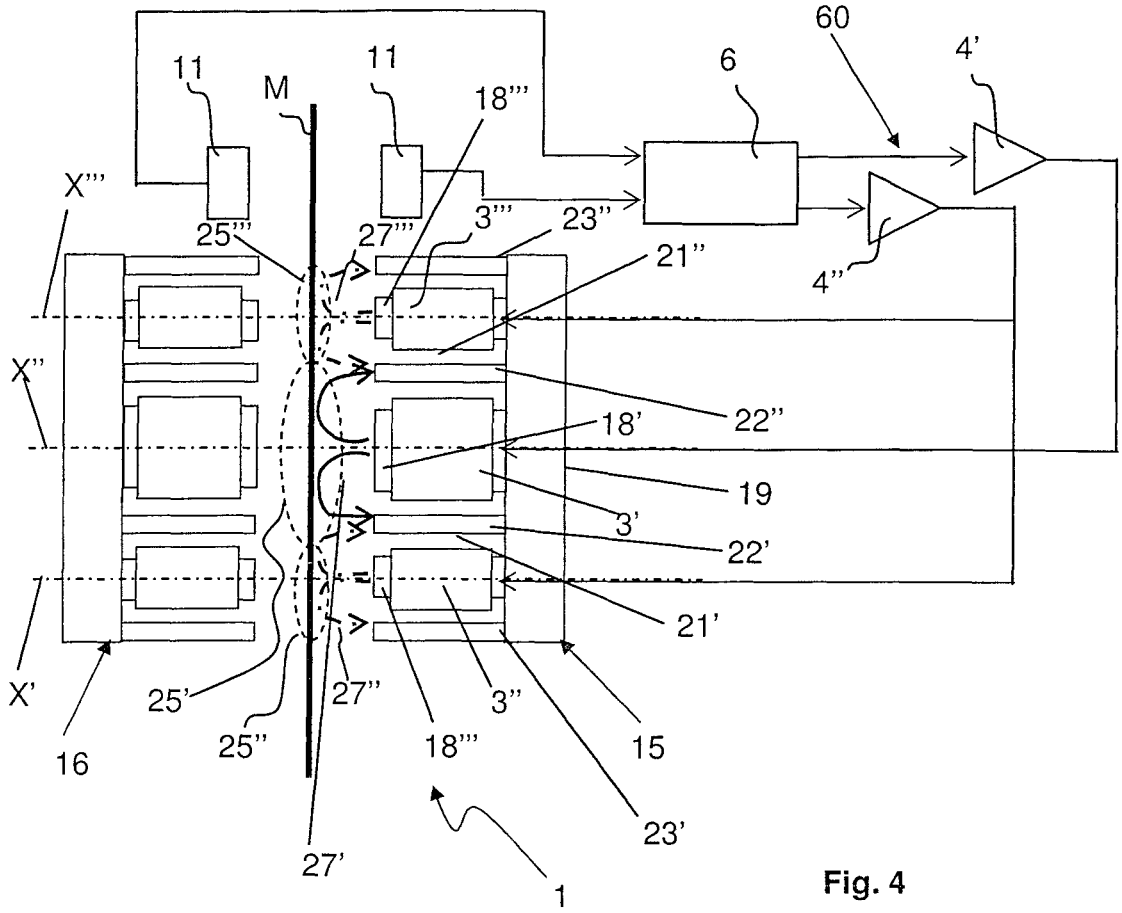
FIG. 4 is a diagrammatic view of a variant of the electromagnetic stabilizer according to the present invention.
Figure 5:
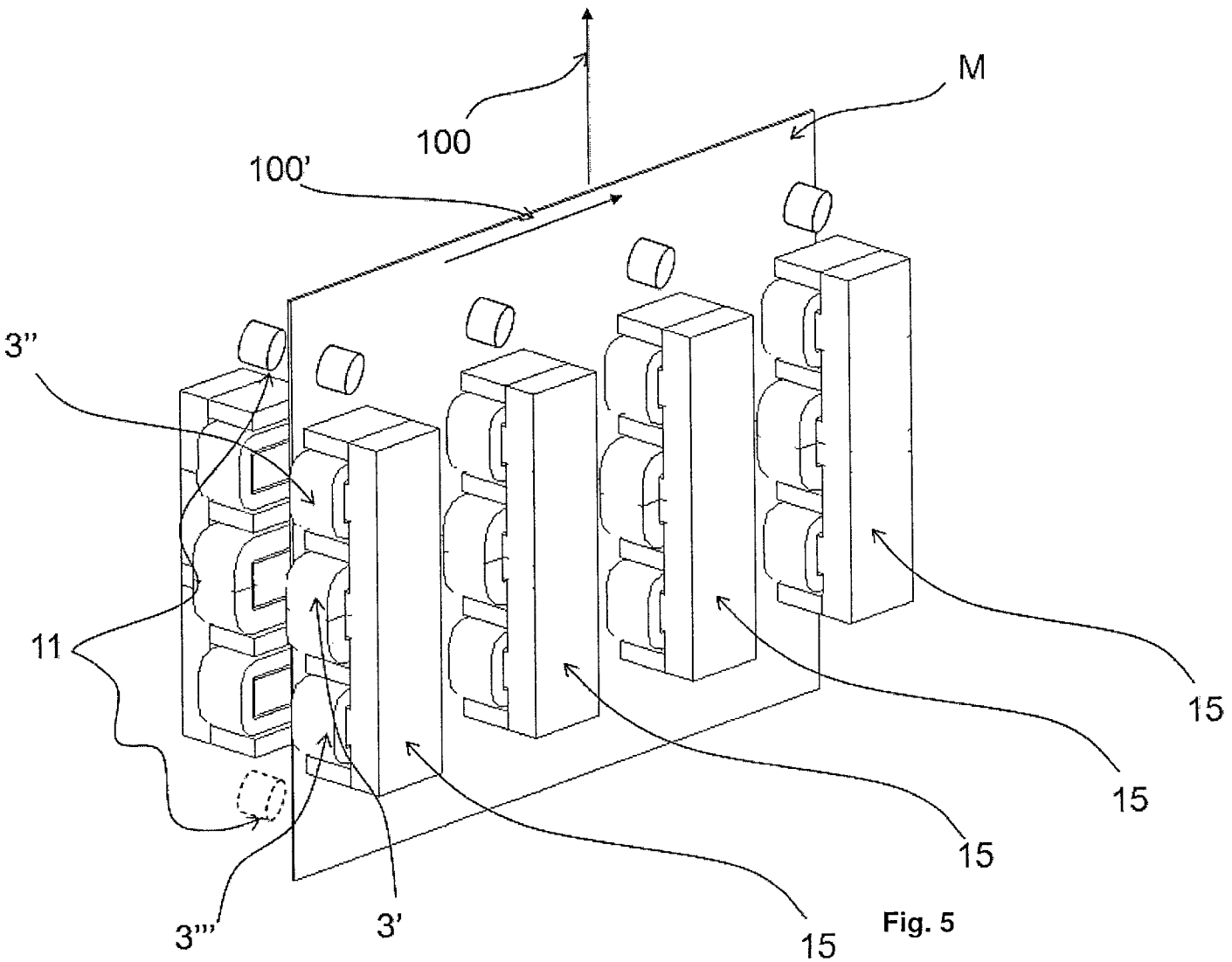
FIG. 5 is an axonometric view, corresponding to that in FIG. 1, of the electromagnetic stabilizer in FIG. 4.
Figure 6:
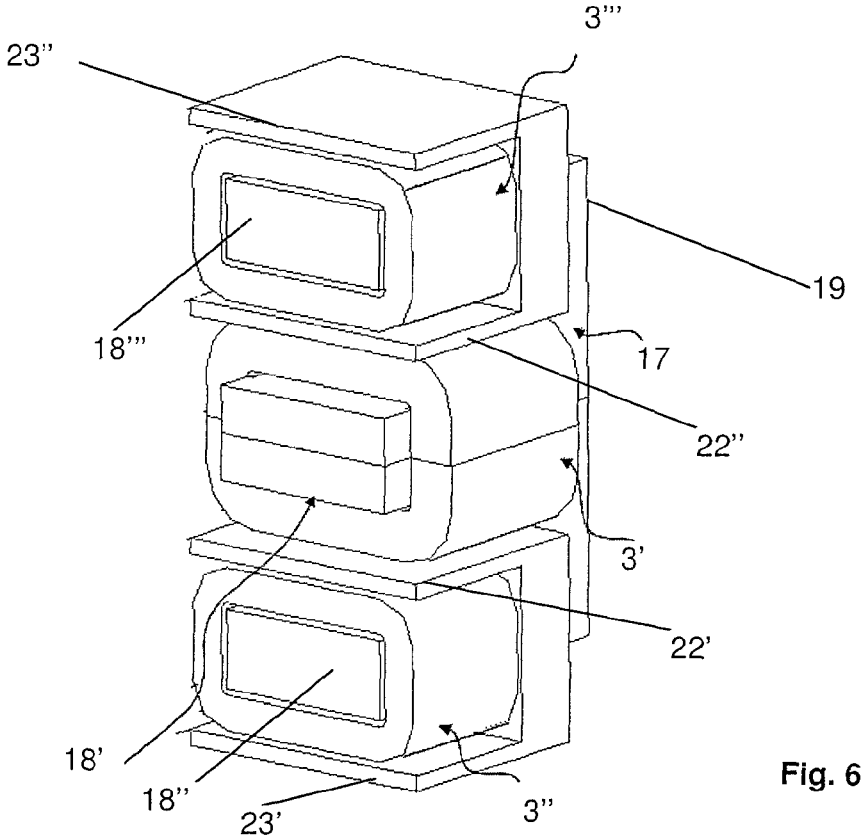
FIG. 6 is an axonometric view of a detail of the electromagnetic stabilizer in FIG. 5.

FIG. 4, on the other hand, shows a second embodiment in which core 17, still made of ferromagnetic material, either rolled or not rolled, has a structure substantially having the shape of letter "E", i.e. comprising three poles 18', 18", 18'" mutually aligned along the feeding direction 100 and a yoke 19 for connection between poles 18', 18", 18'", orthogonal thereto. More in detail, core 17 comprises a first central pole 18' interposed and equally spaced apart with respect to a second lower pole 18" and a third upper pole 18'". The second lower pole 18" and the third upper pole 18'" are located upstream and downstream of the central pole 18', respectively, with respect to the feeding direction 100. Each electromagnet 15, 16 further includes a first coil 3', a second coil 3" and a third coil 3'", mutually spaced apart and wound about poles 18', 18", 18'", respectively, in such a way that the first coil 3' is interposed between the second and the third coil 3", 3'".

In general, according to other variants of the invention (not shown), the core of electromagnets 15, 16 has a shape differing from those shown in FIG. 3 or in FIG. 4, as it may also include a number of poles greater than three. In particular, it is possible to implement variants of the invention in which one or more of poles 18', 18", 18'" of the variants in FIGS. 3 and 4 are replaced by respective pluralities of poles, in which respective coils, identical in structure and function, are wound on all the poles of each plurality.

In both the embodiments in FIGS. 3 and 4, due to the shape of core 17, between the first and the second coil 3', 3" and yoke 19 there is defined a first gap 21' while between the first and the third coil 3', 3'" and yoke 19 there is defined a second gap 21". In the first and second gaps 21', 21" there are arranged a first and a second concentrator 22', 22" of ferromagnetic material, respectively, connected to yoke 19 and oriented parallel to poles 18, 18', 18". The first concentrator 22' is sized and arranged so as to make the first and the second coil 3', 3" magnetically independent of each other while the second concentrator 22" is sized and arranged so as to make the first and the third coil 3', 3'" magnetically independent of each other. A third and a fourth concentrator 23', 23" are arranged along the outer sides of the second and third coil 3", 3'", respectively, in such a way that the second coil 3" is interposed between the first and the third concentrator 22', 23' and the third coil 3'" is interposed between the second and the fourth concentrator 22", 23".

The magnetic field concentrators of ferromagnetic material are sized and arranged in such a way as to prevent the field lines of the first magnetic field and the second magnetic field from affecting the poles on which the coils that generate the second magnetic field and the first magnetic field, respectively, are wound.

In operation, each magnetic field closes on the ferromagnetic material of the core, without affecting the poles on which the coils that generate the other magnetic fields generated in the same core 17 are wound. The re-closure in the air and through strip M of the field lines of each magnetic field does not affect the poles on which the coils that generate the other magnetic fields are wound.

In other variants of the present invention, the poles and concentrators of ferromagnetic material connected to the core are mutually aligned along the feeding direction 100 and distributed in such a way that each of the coils wound about the respective pole is interposed between two of such concentrators.

In the embodiment in FIG. 3, where the core of electromagnets 15, 16 includes only two poles and two coils wound about them, respectively, there is provided a single gap between the two coils and a concentrator arranged in such a gap. In this embodiment, the two coils are preferably different from each other by number of turns and/or section of the pole on which they are wound.

Coils 3', 3", 3'" of the embodiment in FIG. 4 comprise respective pluralities of coils wound about a respective axis X', X", X'" of the respective pole 18', 18", 18'" orthogonal with respect to the theoretical plane 50 and yoke 19. In the embodiment in the accompanying figures, the second coil 3" and the third coil 3'" are identical to each other while the first coil 3' is different from the other two coils 3", 3'", differing by larger number of coils and/or larger section of pole 18'.

The electromagnetic stabilizer 1 further comprises a power supply circuit 60 of electromagnets 15, 16 including a controller 6 and two power sources 4' and 4" to electrically power coils 3', 3", 3'". In general, the use of one controller 6 and two power sources 4' and 4" is provided for each electromagnet 15, 16. The first source 4' is electrically connected to the first coil 3' for generating a first magnetic field 27'. The second source 4" is electrically connected to the second and third coil 3", 3'" for generating a second and a third magnetic field 27", 27'", respectively, of identical intensity. Alternatively, different intensity and dynamics may be provided for coils 3" and 3'", such as by adding a third power source connected to the third coil 3'" while the second source 4" is only used for the second coil 3".

Due to the presence of the ferromagnetic concentrators 22', 22", 23', 23", the three magnetic fields 27', 27", 27'" are active between the respective pole 18', 18", 18'" and the pair of ferromagnetic concentrators placed at the sides of the respective pole 18', 18", 18'", respectively. Accordingly, the first magnetic field 27' is defined between the first pole 18' and the pair of ferromagnetic concentrators consisting of the first and second concentrators 22', 22", the second magnetic field 27" is defined between the second pole 18" and the pair of ferromagnetic concentrators consisting of the first and third concentrator 22', 23', the third magnetic field 27' is defined between the third pole 18' and the pair of concentrators ferromagnetic consisting of the second and fourth concentrator 22", 23". The three magnetic fields 27', 27", 27'" are therefore active on respective and distinct areas 25', 25", 25'" of strip M. This leads to particular advantages when at least one of the magnetic fields 27', 27", 27'" is of variable intensity, since this prevents the variable magnetic field from affecting the power source of the other magnetic fields, either static or variable, generated by the electromagnet itself.

With reference to the variants in the accompanying figures, due to the structural differences between the first coil 3' and the other two coils 3" and 3'", the respective magnetic fields 27', 27", 27 " are suitably sized so as to fulfill the two distinct functions required to the magnetic stabilizer 1, i.e. the correction of the transversal deformation and the reduction of the oscillations of strip M. In particular, the number of turns of the first coil 3' and the section of pole 18' are chosen so as to maximize the magnetic force determined by the magnetic field 27' while the number of turns of coils 3" and 3'" and the sections of poles 18" and 18'" are limited, so as to maximize the dynamic response, and thus the rapid variation of the magnetic forces determined by the magnetic fields 27", 27'". Using the power supplied by the respective sources 4', 4", the first magnetic field 27' is made static or slowly time-variable in order to provide a corrective action of the transversal deformation of strip M while the second and third magnetic field 27", 27'" are made variable with appropriate frequency for eliminating or limiting the oscillations of strip M.

The variable magnetic fields 27", 27'" generated by coils 3" and 3'", thanks to the presence of concentrators 22', 22", 23', 23", do not close through the central pole 18' and thus do not interfere with source 4' of the first coil 3', thus guaranteeing the correct operation thereof.

Figure 7:
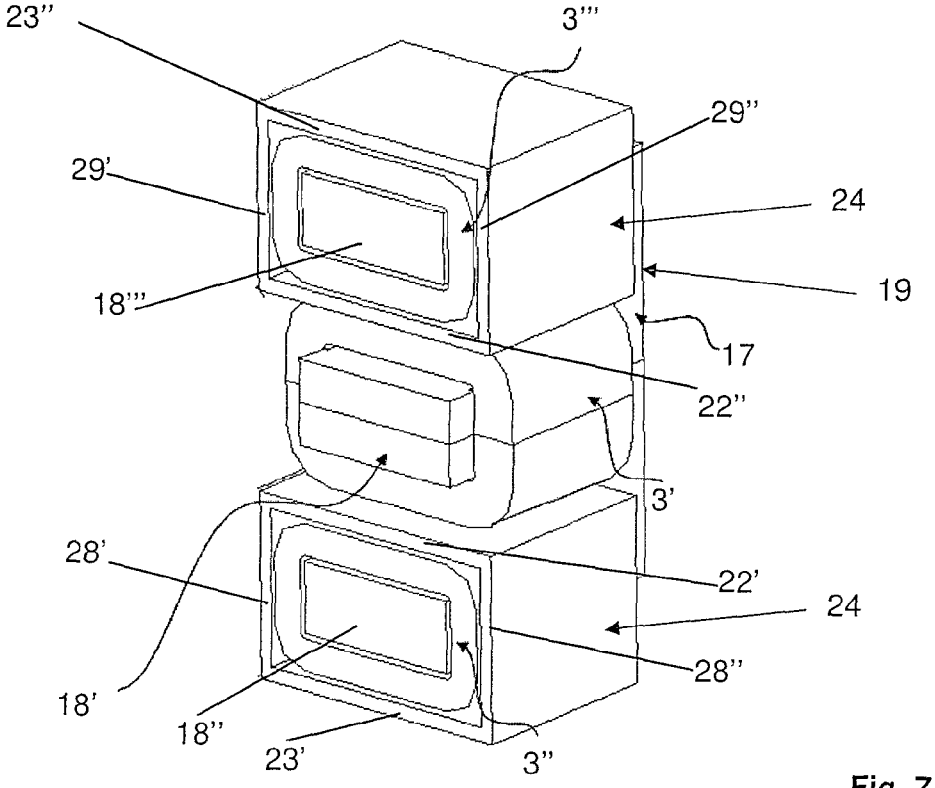
FIG. 7 is an axonometric view of a variant of the detail in FIG. 6.

With reference to the embodiment in FIG. 7, the use of two box-shaped ferromagnetic concentrators 24 is provided, each consisting of four flat sides, shaped and arranged so as to surround the second and third coil 3", 3'" around the respective winding axes X", X'". In operation, the ferromagnetic concentrator 24 of the second coil 3" integrates the first and the third flat concentrators 22', 23', connected to each other by two side walls 28', 28" while the ferromagnetic concentrator 24 of the third coil 3'" integrates the second and fourth flat concentrators 22", 23", connected to each other by two side walls 29', 29". Compared to the variant in FIG. 6, this allows a greater volume of ferromagnetic material available to be used for closing the electromagnetic fields 27", 27'", in particular if the flat concentrators 22', 22", 23', 23" are not sufficient because under conditions of saturation.

The magnetic fields 27', 27", 27'" are generated by coils 3', 3" and 3'" by means of the power sources 4', 4" controlled by controller 6 as a function of the position and shape of the strip with respect to the ideal position and shape represented by the theoretical plane 50. In order to identify such a shape and position, the magnetic stabilizer 1 comprises a plurality of position sensors 11, connected to controller 6 so that controller 6 can operate in closed loop. Sensors 11 are of the "eddy current" type, or capacitive or laser, or of another known type, provided that they can provide controller 6 with the information concerning the position and, consequently, also the shape of strip M, necessary for the operation of stabilizer 1.

Figure 8:
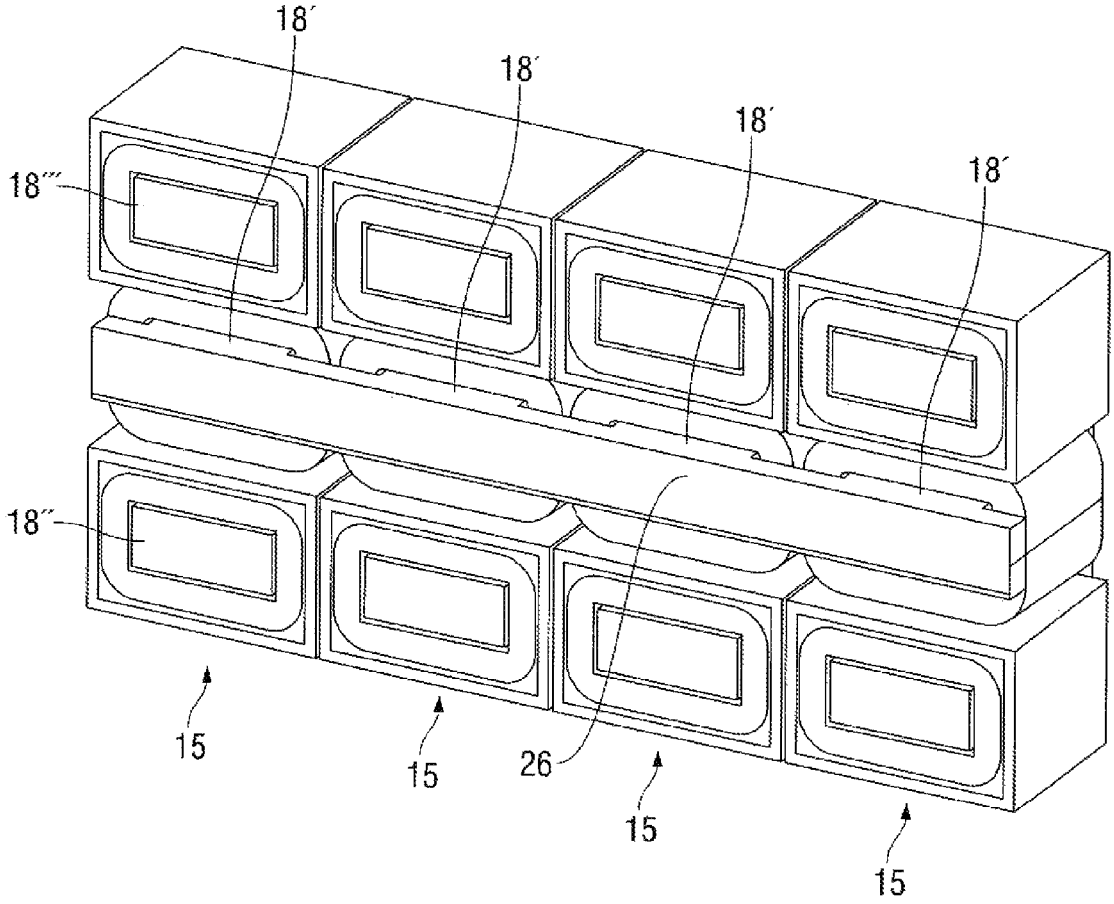
FIG. 8 is an axonometric view of a variant of the electromagnetic device in FIG. 5.

With reference to FIG. 8, the electromagnetic stabilizer 1 also comprises a first connecting element 26 of ferromagnetic material which mutually connects cores 17 of electromagnets 15 of the first plurality and a second connecting element (not shown) that connects the cores of electromagnets 16 of the second plurality (not shown in FIG. 8). The first connecting element 26 and the second connecting element are placed in reciprocal mirroring positions with respect to the theoretical feeding plane 50 (as depicted b the dash-dot lines in FIG. 3).

In particular, in the embodiment shown in FIG. 8, the first connecting element 26 and the second connecting element connect the central poles 18' of electromagnets 15, 16, respectively, to each other.

The first and the second connecting elements are preferably shaped as a bar having rectangular section made of ferromagnetic material, either rolled or not rolled, and they have the function of conveying and spreading the magnetic fields.

The present invention also relates to a system for coating, such as a galvanizing plant, a strip M of ferromagnetic metal material comprising an electromagnetic stabilizer 1, implemented as described above.

The present invention further relates to a process for stabilizing and correcting the deformation of a strip M of ferromagnetic metal material during its feeding. Such a process comprises the steps of:

generating a first plurality of magnetic fields 27' aligned along a transversal direction 100' parallel to a theoretical feeding plane 50 of strip M and orthogonal to a feeding direction 100 of strip M. The magnetic fields 27' are static or slowly time-variable and having such intensity as to correct the transversal deformation of said strip M;

generating a second and a third plurality of magnetic fields 27", 27'" also aligned along the transversal direction 100', respectively. The magnetic fields 27", 27'" are spaced apart from the magnetic fields 27' of the first plurality along the feeding direction 100 and are sized and supplied so as to quickly vary for correcting the oscillations of strip M.

In order to generate the magnetic fields 27', 27", 27'", the plurality of electromagnets 15, 16 of the magnetic stabilizer 1 or of another stabilizer of the conventional type, may be used. However, the process for stabilizing and correcting the deformation of a strip M of ferromagnetic metal material according to the present invention is characterized in that it comprises the further step of interposing one or more ferromagnetic concentrators, such as the flat concentrators 22', 22", 23', 23" or the box-shaped concentrators 24, between the magnetic fields 27', 27", 27'". In this way, the second and third magnetic fields 27", 27'" are conveyed in such a way that the respective field lines are closed along a path that develops in the air and inside strip M independently, as compared to the first magnetic field 27'. In particular, the field lines of the second and third magnetic fields 27", 27'" do not affect the magnetic pole 18' on which coil 3' which generates the first magnetic field 3' is wound. In this way, the variable magnetic fields 27", 27'", closing through the ferromagnetic concentrators, do not interfere with source 4' of the first coil 3', thus ensuring the uncoupling thereof and, therefore, the proper operation and consequently the proper generation of the first magnetic field 27'.

The first magnetic fields 27' affect an area 25' of strip M different from areas 25" and 25'" on which fields 27" and 27'" close. In this way, fields 27" and 27'" can act on areas 25" and 25'" of strip M which are not saturated by the strong magnetic fields 27' used for correcting the deformation of strip M, with an increase in the effectiveness of the stabilizing action. Moreover, in the absence of concentrators, the first magnetic fields 27' would close in the ferromagnetic material of the electromagnet, through poles 18" and 18'", leading them to saturation and making the control action of the stability of the shape of strip M less effective.

The described technical solutions allow the intended task and objects to be fully achieved with reference to the mentioned prior art, achieving a plurality of further advantages, among which:

the compactness of the electromagnetic stabilizer 1;

the implementation of power sources 4' and 4" having lesser power compared to the ease of using a single power source unnecessarily oversized, with consequent reduction of cost and space;

a sturdy control system 6, such as to adapt to different operating conditions (e.g. strips of different thickness), without the need to modify the internal parameters of the control system 6.

The separation of the two actions of correcting the deformation and the oscillation allows each core 17 to be made with different materials, in order to reduce costs and, at the same time, limit losses. In fact, the upper and lower poles 18", 18''', subject to the variable magnetic fields 27", 27''', may be made of rolled material, i.e. consisting of reciprocally insulated sheets insulated, so as to reduce losses due to hysteresis and eddy currents, while the central pole 18' may be preferably made of solid ferromagnetic material.

The invention claimed is:

1. An electromagnetic stabilizer for stabilizing and correcting the deformation of a strip made of ferromagnetic metal material during its feeding, said stabilizer comprising:

a first plurality of electromagnets aligned along a transversal direction parallel to a theoretical feeding plane of said strip and orthogonal to a feeding direction of said strip, a second plurality of electromagnets arranged in a position mirroring said first plurality of electromagnets with respect to said theoretical plane, wherein each of said electromagnets comprises:

a core equipped with at least a first and a second pole, at least a first and a second coil wound about said first and second pole, respectively, a first and a second power source to supply said first and second coil, respectively, so as to generate a first and a second magnetic field, respectively, a gap extending between said first and second coil, characterized in that each of said electromagnets further comprises at least one concentrator made of ferromagnetic material connected to said core and sized and arranged in said gap so as to make said first and second coil magnetically independent from each other.

2. An electromagnetic stabilizer according to claim 1, wherein each of said electromagnets comprises a plurality of concentrators made of ferromagnetic material connected to said core, aligned with said first and, second coil along said feeding direction and arranged so that each of said coils is interposed between two of said concentrators.

3. An electromagnetic stabilizer according to claim 1, wherein said first coil differs from said second coil in number of turns and/or diameter.

4. An electromagnetic stabilizer according to claim 2, wherein said first coil differs from said second coil in number of turns and/or diameter.

5. An electromagnetic stabilizer according to claim 1, wherein each of said electromagnets further comprises at least a third coil, which is identical to said second coil, said first, second and third coil being aligned along the feeding direction of said strip and arranged so that said first coil is interposed between said second and third coil.

6. An electromagnetic stabilizer according to claim 2, wherein each of said electromagnets further comprises at least a third coil, which is identical to said second coil, said first, second and third coil being aligned along the feeding direction of said strip and arranged so that said first coil is interposed between said second and third coil.

7. An electromagnetic stabilizer according to claim 5, wherein said third coil is supplied by said second power source.

8. An electromagnetic stabilizer according to claim 1, wherein at least one of said concentrators is shaped so as to surround one of said coils around a respective winding axis of said coil.

9. An electromagnetic stabilizer according to claim 1, wherein said stabilizer further comprises:

a first connection element made of ferromagnetic material which connects the cores of said first plurality of electromagnets.

10. An electromagnetic stabilizer according to claim 9, wherein said first connection element made of ferromagnetic material connects said first poles of each electromagnet of said first plurality of electromagnets.

11. An electromagnetic stabilizer according to claim 1, wherein said device comprises a plurality of position sensors adapted to measure the position and the shape of said strip with respect to said theoretical feeding plane, each feeding coil of each of said electromagnets being fed according to said position and said shape of said strip with respect to said theoretical feeding plane.

12. A coating system for coating a strip made of ferromagnetic metal comprising an electromagnetic stabilizer according to claim 1.

13. A process for stabilizing and correcting the deformation of a strip made of ferromagnetic metal during its feeding, said process comprising the steps of:

generating a first plurality of magnetic fields aligned along a transversal direction parallel to a theoretical feeding plane of said strip and orthogonal to a feeding direction of said strip, said first plurality of magnetic fields being sized to correct the transversal deformation of said strip;

generating a second plurality of magnetic fields aligned along a transversal direction parallel to a theoretical feeding plane of said strip and orthogonal to a feeding direction of said strip, said second plurality of magnetic fields being spaced apart from said first plurality of magnetic fields along said feeding direction, said second plurality of magnetic fields being sized to correct the oscillations of said strip; and interposing one or more ferromagnetic concentrators between said first plurality of magnetic fields and said second plurality of magnetic fields, said concentrators being sized and arranged so as to make said first plurality of magnetic fields magnetically independent with respect to said second plurality of magnetic fields.

14. An electromagnetic stabilizer for stabilizing and correcting the deformation of a strip made of ferromagnetic metal material during its feeding, said stabilizer comprising:

a first plurality of electromagnets aligned along a transversal direction parallel to a theoretical feeding plane of said strip and orthogonal to a feeding direction of said strip, a second plurality of electromagnets arranged in a position mirroring said first plurality of electromagnets with respect to said theoretical plane, wherein each of said electromagnets comprises:

a core equipped with at least a first and a second pole, at least a first and a second coil wound about said first and second pole, respectively, a first and a second power source to supply said first and second coil, respectively, so as to generate a first and a second magnetic field, respectively, a gap extending between said first and second coil, characterized in that each of said electromagnets further comprises a plurality of concentrators made of ferromagnetic material connected to said core, arranged in said gap so as to make said first and second coil magnetically independent from each other and aligned with said first and second coil along said feeding direction and arranged so that each of said coils is interposed between two of said concentrators.

* * * * *